US008915663B2

(12) United States Patent
Rolion et al.

(10) Patent No.: US 8,915,663 B2
(45) Date of Patent: Dec. 23, 2014

(54) WRITING INSTRUMENT WITH ERASER PROTECTED BY A SLEEVE

(75) Inventors: Franck Rolion, Asnières sur Oise (FR); Richard O'Brien, Oxford, CT (US); Samuel Malinverni, Paris (FR)

(73) Assignee: Societe BIC, Clichy (FR)

( * ) Notice: Subject to any disclaimer, the term of this patent is extended or adjusted under 35 U.S.C. 154(b) by 400 days.

(21) Appl. No.: 12/863,273

(22) PCT Filed: Jan. 9, 2009

(86) PCT No.: PCT/FR2009/050031

§ 371 (c)(1),
(2), (4) Date: Jul. 16, 2010

(87) PCT Pub. No.: WO2009/092947

PCT Pub. Date: Jul. 30, 2009

(65) Prior Publication Data

US 2010/0316431 A1 Dec. 16, 2010

(30) Foreign Application Priority Data

Jan. 16, 2008 (FR) ..... 08 50257

(51) Int. Cl.
*B43K 25/00* (2006.01)
*B43K 29/02* (2006.01)
*B43K 21/00* (2006.01)

(52) U.S. Cl.
CPC ..... *B43K 29/02* (2013.01); *B43K 21/003* (2013.01)
USPC ..... 401/52; 401/92; 401/93; 15/433

(58) Field of Classification Search
CPC ..... B43K 29/02; B43K 21/003
USPC ..... 401/30, 52, 68, 75, 87; 15/429, 433
See application file for complete search history.

(56) References Cited

U.S. PATENT DOCUMENTS

| | | | |
|---|---|---|---|
| 1,530,558 | A | 3/1925 | Hansen |
| 2,164,433 | A | 7/1939 | Smith |
| 2,198,335 | A | 4/1940 | Gaimari |
| 4,904,101 | A | 2/1990 | Petterson |

(Continued)

FOREIGN PATENT DOCUMENTS

| | | |
|---|---|---|
| EP | 0 321 581 | 6/1989 |
| EP | 0 545 917 | 6/1993 |

(Continued)

*Primary Examiner* — David Walczak
*Assistant Examiner* — Jennifer C Chiang
(74) *Attorney, Agent, or Firm* — Jones Day

(57) ABSTRACT

A writing instrument that includes a shaft and an eraser exit device. The eraser exit device includes an eraser protection sleeve that is mobile at least in rotation relative to the shaft so that the eraser can assume a maximum exit configuration and a retraction configuration, and an eraser holder provided with at least a first longitudinal guiding member directly interacting with a first complementary guiding member connected to the shaft so as to prevent any rotation movement between the holder and the shaft, and provided with at least a second guiding member that interacts with a second complementary guiding member connected to the sleeve. The sleeve has a front portion surrounding the rear end of the shaft and a rear portion having an inner guiding portion including the second complementary guiding member.

12 Claims, 4 Drawing Sheets

(56) References Cited

U.S. PATENT DOCUMENTS

| | | | | | |
|---|---|---|---|---|---|
| 5,015,111 | A | | 5/1991 | Petterson | |
| 5,022,774 | A | | 6/1991 | Kageyama et al. | |
| 5,062,727 | A | | 11/1991 | Kageyama et al. | |
| 5,090,831 | A | * | 2/1992 | Kageyama et al. | 401/52 |
| 5,207,522 | A | | 5/1993 | Kageyama et al. | |
| 5,236,270 | A | | 8/1993 | Kageyama et al. | |
| 5,306,085 | A | * | 4/1994 | Kobayashi | 401/29 |
| 5,370,471 | A | | 12/1994 | Kageyama et al. | |
| 5,642,953 | A | | 7/1997 | Kobayashi et al. | |
| 5,662,425 | A | | 9/1997 | Mitsuya | |
| 5,683,191 | A | | 11/1997 | Kageyama et al. | |
| 5,700,120 | A | | 12/1997 | Manning et al. | |
| 5,702,193 | A | | 12/1997 | Kageyama et al. | |
| 5,791,797 | A | | 8/1998 | Kageyama et al. | |
| 5,803,637 | A | | 9/1998 | Mitsuya | |
| 5,836,707 | A | | 11/1998 | Kageyama et al. | |
| 5,890,825 | A | | 4/1999 | Kageyama et al. | |
| 5,927,882 | A | | 7/1999 | Kageyama | |
| 5,961,236 | A | | 10/1999 | Kageyama | |
| 5,988,913 | A | | 11/1999 | Kageyama et al. | |
| 5,988,914 | A | | 11/1999 | Kageyama et al. | |
| 6,099,182 | A | | 8/2000 | Kageyama et al. | |
| 6,210,058 | B1 | | 4/2001 | Kageyama et al. | |
| 6,517,271 | B1 | | 2/2003 | Kageyama et al. | |
| 6,517,272 | B1 | * | 2/2003 | Kageyama et al. | 401/92 |
| 6,783,292 | B2 | | 8/2004 | Arai et al. | |
| 6,984,087 | B1 | * | 1/2006 | Reinbold et al. | 401/195 |
| 7,284,927 | B2 | * | 10/2007 | Kageyama | 401/93 |

FOREIGN PATENT DOCUMENTS

| | | | |
|---|---|---|---|
| EP | 0 620 127 | | 10/1994 |
| EP | 0 850 784 | | 7/1998 |
| JP | S64-40588 | | 3/1989 |
| JP | H04-37392 | | 3/1992 |
| JP | 6108198 | U | 4/1994 |
| JP | 8039988 | A | 2/1996 |
| JP | 11078376 | A | 3/1999 |
| JP | 2000-108586 | | 4/2000 |

* cited by examiner

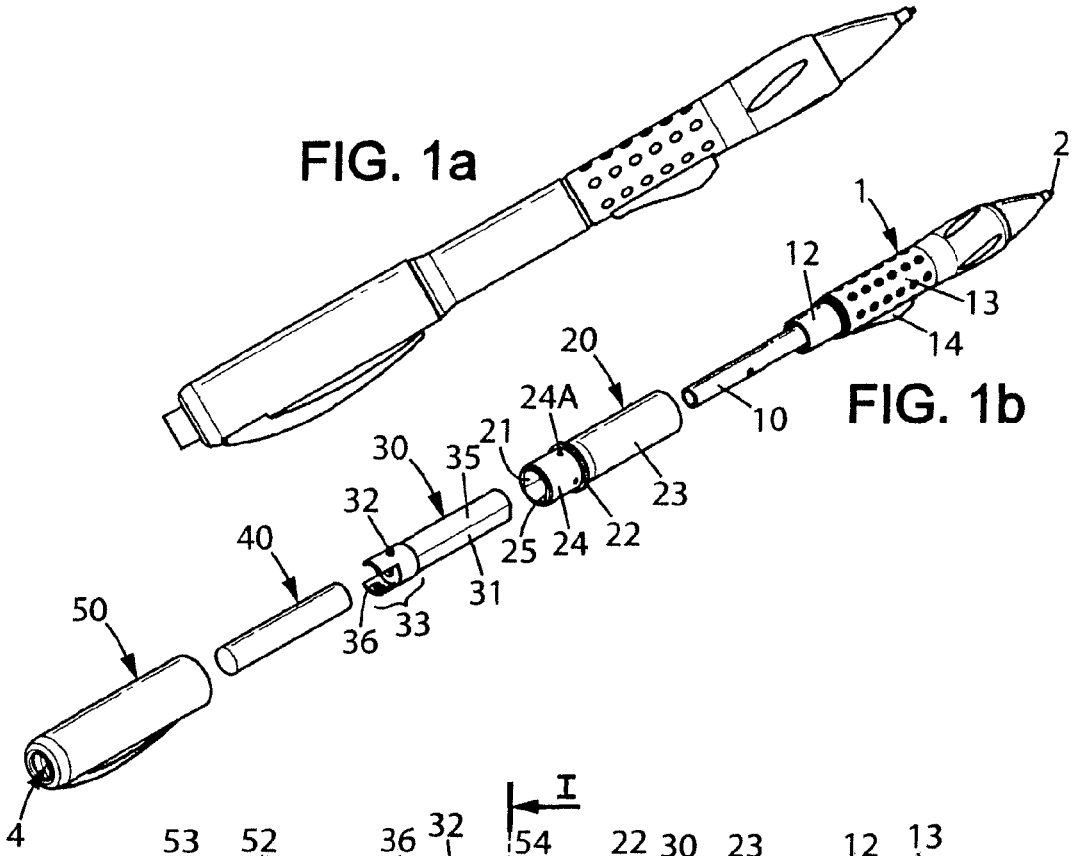
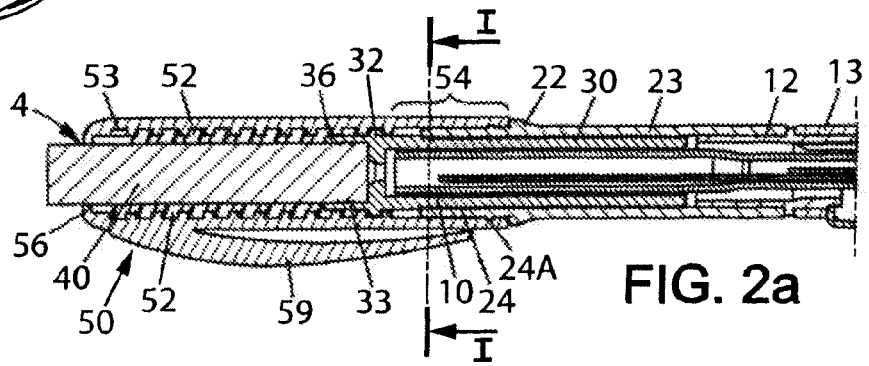
FIG. 2a
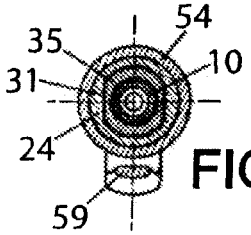
FIG. 2b
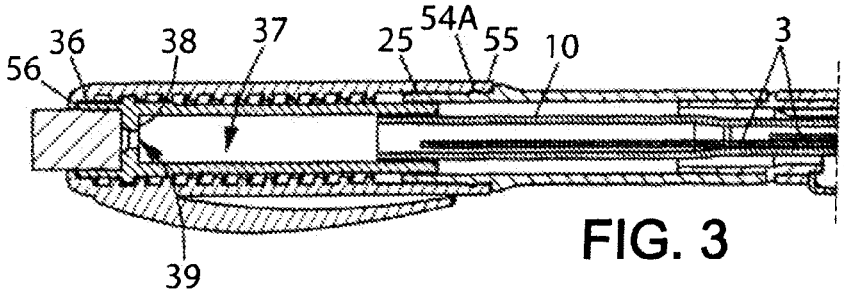
FIG. 3

WRITING INSTRUMENT WITH ERASER PROTECTED BY A SLEEVE

This application is a national stage application of PCT/FR2009/050031, filed on Jan. 9, 2009, which claims priority to French Patent Application No. 0850257, which was filed on Jan. 16, 2008.

FIELD OF THE EMBODIMENTS OF THE PRESENT INVENTION

The embodiments of the present invention relates generally to a writing instrument comprising a shaft extending longitudinally between a front end with a writing tip and a rear end, further comprising an eraser exit device that preferably includes:

- an eraser capable of adopting a maximum exit configuration and a retraction configuration in which it is at least partially protected;
- an eraser protection sleeve having a generally cylindrical inner surface, mobile with respect to the shaft between a first position for which the eraser is in a retraction configuration and a second position for which the eraser is in a maximum exit configuration;
- an eraser holder to which the eraser is fixed,
- means for allowing a relative translational motion between the eraser holder and the sleeve in the longitudinal direction.

BACKGROUND OF THE EMBODIMENTS OF THE PRESENT INVENTION

A first category of writing instruments of this type relates to devices in which the eraser holder is mobile in translation and prevented from rotating with respect to the shaft, and the protection sleeve is mobile in rotation with respect to the shaft while prevented from translational motion except optionally for the actuation of a feed mechanism of a writing cartridge. Means for preventing the rotation of the eraser holder with respect to the shaft conventionally comprise at least one first longitudinal guiding member such as a groove or a rib provided on the holder and interacting directly with a first complementary longitudinal guiding member provided on a part prevented from rotation with respect to the shaft. The means allowing for a relative translational motion between the eraser holder and the sleeve conventionally comprise at least one second guiding member such as a spiral groove or a lug provided on the holder and interacting with a second complementary guiding member connected to the sleeve.

An example of a writing instrument in this first category is described in U.S. Pat. No. 5,683,191, which relates to a propelling pencil, the lead feed of which is actuated by the user pressing on the protection sleeve in order to displace the latter in translation with the lead container tube. In a first embodiment, the eraser holder has at the front a tubular projection with a polygonal cross-section slidably fitted in contact around a rear portion of the lead container tube that has a cross-section with a complementary shape. The displacement in translation of the eraser holder is thus guided while prevented from rotating with respect to the lead container tube. The eraser holder is surrounded over its whole length by the protection sleeve which comprises a tubular projection capable of sliding against the inner wall of the shaft. This device however has certain drawbacks, in particular owing to the fact that two tubular elements are arranged radially between the lead container tube and the shaft, leaving a restricted central diametral space and disadvantaging the capacity of the lead container. Moreover, radial clearances are required between the tubular elements inside the shaft so that the latter can slide against each other, and the multiplicity of these clearances compromises keeping the eraser holder in axial alignment with the shaft.

A second category of writing instruments of this type relates to devices in which the eraser holder is prevented from translation with respect to the shaft, except optionally for the actuation of a feed mechanism of a writing cartridge, and the protection sleeve is mobile at least in translation with respect to the shaft. For a device of the propelling pencil type, the eraser holder is generally firmly connected to the rear end of a lead container tube that can be displaced in translation in the shaft in order to feed the lead only. The eraser holder therefore remains immobile in the shaft when the protection sleeve is displaced between the retraction configuration and the maximum exit configuration of the eraser.

An example of a writing instrument in this second category is described by the registered Japanese utility model JP2558803Y2, which relates to a propelling pencil, the lead feed of which is actuated by the user pressing on the protection sleeve in order to displace the latter in translation with the lead container tube. The sleeve has a front portion surrounding the rear end of the shaft. The eraser holder is firmly connected to the rear portion of the container tube by an intermediate tube comprising protrusions interacting with locking means provided on the sleeve in order to immobilize the sleeve in one or other of the retraction or maximum exit configurations of the eraser. However, this device has certain drawbacks, in particular owing to the fact that the locking means are relatively difficult to produce and furthermore there is a risk of the locking means becoming accidentally unlocked by the user while erasing. Moreover, the device does not include a system for locking the lead feed, as a consequence of which the use of the eraser while holding the writing instrument by the shaft risks causing a feed movement of the eraser holder towards the shaft and therefore the unwanted feeding of the lead.

SUMMARY OF THE EMBODIMENTS OF THE PRESENT INVENTION

An embodiment of the present invention is to provide an alternative solution to these eraser exit devices of the prior art, making it possible in particular to simplify the production of eraser exit devices in both the first and second abovementioned categories.

To this end, an object of the embodiments of the present invention is a writing instrument such as defined generally in the foregoing, further comprising the following characteristics:

- the mobility of the protection sleeve with respect to the shaft takes place at least in rotation;
- the eraser holder has at least one first longitudinal guiding member interacting directly with a first complementary longitudinal guiding member connected to the shaft in order to prevent any rotational motion between the holder and the shaft, and has at least one second guiding member interacting with a second complementary guiding member connected to the sleeve so that the rotation of the sleeve drives the relative translational motion between the holder and the sleeve in the longitudinal direction;
- the sleeve has a front portion surrounding the rear end of the shaft and a rear portion that does not surround the shaft that has an inner guiding surface comprising the second complementary guiding member; and the eraser holder is capable of sliding directly against the inner wall of the shaft and has an outer guiding surface comprising the second guiding member.

As a result of these arrangements, a relatively simple eraser exit device is obtained that responds to the particular constraints of writing instruments of this type. In particular, the capability of the eraser holder to slide directly against the inner wall of the shaft is advantageous in order to keep the eraser holder more firmly in axial alignment with the shaft, making it possible to limit misalignments of the holder caused by the transverse forces exerted on the eraser in use. Moreover, the fact that the protection sleeve has a front portion surrounding the rear portion of the shaft makes it possible not only to optimize the diameter of the eraser but also to hold the sleeve more firmly in axial alignment with the shaft. These arrangements contribute to the rigidity of the eraser exit device in the transverse direction and thus improve the comfort of use, ensuring that the user does not feel play in the mechanism of this device in particular if the writing instrument is held at least partially by the shaft in order to use the eraser.

According to an embodiment of the present invention, the shaft includes stop means capable of interacting with a front end edge of the sleeve in order to prevent an axial displacement of the sleeve towards the shaft at least in the maximum exit configuration of the eraser. As a result of these arrangements, if the writing instrument is held at least partially by the shaft in order to use the eraser, the pressure exerted on the eraser can be relatively strong without the risk of causing sliding in translation of the eraser holder in conjunction with the sleeve towards the shaft. This has a particular advantage in the case of a writing instrument of which the feed of a writing cartridge is actuated by pressing the protection sleeve in order to displace a container tube of the cartridge in translation, since the writing cartridge feed is locked in the maximum exit configuration of the eraser.

In other preferred embodiments of the present invention, one or other of the following arrangements is used:

the outer guiding surface of the eraser holder is adjacent to the inner guiding surface of the sleeve, and the at least one second guiding member projects radially outwards and is axially offset towards the rear of the eraser holder with respect to the at least one first longitudinal guiding member;

the second complementary guiding member is a groove formed in the inner guiding surface of the sleeve;

the eraser holder preferably has a front projection extending longitudinally, the outer surface of which at least approximately forms a cylinder;

the groove constituting the second complementary guiding member forms a spiral path in the inner guiding surface of the sleeve, and the eraser holder preferably has at least two laterally opposite second guiding elements engaged in the groove.

In other preferred embodiments relating to the first category previously defined for which the protection sleeve is generally prevented from moving in translation with respect to the shaft and the eraser holder is mobile in translation and prevented from rotating with respect to the shaft, one or other of the following provisions in particular is used:

the sleeve is linked to the shaft so as to be able to rotate relative to the shaft without the possibility of movement in translation, this arrangement being particularly suitable for a writing instrument on which the feed of a writing cartridge is actuated by a push element arranged laterally on the shaft;

the shaft comprises a rear portion having an essentially cylindrical outer wall surrounded by the front portion of the sleeve and which includes at least two protrusions arranged in a peripheral circle, the front portion having an inner wall comprising an annular groove in which the protrusions are engaged;

the at least one first longitudinal guiding member is formed by a flat extending longitudinally on the outer surface of the front projection of the holder, and the rear portion of the shaft preferably has an inner wall on which is formed at least one flat constituting the first complementary longitudinal guiding member;

the stop means capable of interacting with a front end edge of the sleeve are formed at the front of the protrusions of the rear portion of the shaft by an annular portion projecting outside the shaft, the front end edge of the sleeve being capable of abutting against the annular part;

the writing instrument includes a feed mechanism of a writing cartridge, the shaft comprises a first essentially tubular part passed through laterally by an actuation button of the feed mechanism and further comprises a second essentially tubular part comprising the first complementary longitudinal guiding member and linked in a fixed manner to the first part.

In other preferred embodiments relating to the second category previously defined for which the protection sleeve is at least mobile in translation with respect to the shaft and the eraser holder is generally prevented from moving in translation with respect to the shaft, one or other of the following provisions in particular is used:

the writing instrument comprises a feed mechanism of a writing cartridge, the eraser holder is firmly connected to a container tube of the feed mechanism arranged inside the shaft coaxially with the holder and capable of sliding in translation with the holder in order to actuate the feed mechanism;

the front projection of the eraser holder as well as the outer guiding surface of the holder are essentially cylindrical, and the external diameter of the outer guiding surface is greater than the external diameter of the front projection while being substantially equal to the diameter of the inner wall of the shaft:

the at least one first longitudinal guiding member is formed by a protrusion projecting externally on the outer guiding surface of the eraser holder, and the first complementary longitudinal guiding member is formed by a longitudinal slot formed in the shaft, the slot opening onto the rear end of the shaft and capable of allowing the protrusion to slide in translation without the possibility of rotation;

the shaft preferably has an essentially cylindrical outer wall and comprises a rear projection, the external diameter of which is smaller than the external diameter of the shaft, so that the outer surface of the shaft forms an annular shoulder constituting the stop means capable of interacting with a front end edge of the sleeve, the front portion of the sleeve having an internal diameter substantially equal to the external diameter of the rear projection;

the sleeve is formed by assembling at least two respectively front and rear parts having inner guiding surfaces of the same diameter, each inner guiding surface being adjacent to the outer guiding surface of the eraser holder and having at least one edge constituting a cam channel, the respective cam channels of the two parts of the sleeve being shaped so that a groove is created, delimited by two cam channels that are longitudinally opposite once the two parts are assembled, each groove constituting the second complementary guiding member;

the rear part of the sleeve preferably has an essentially circular front opening of a certain diameter and the front part of the sleeve preferably has a rear projection comprising at least one cam channel, the rear projection having a outer surface defining a cylinder the diameter of which is substantially equal to the diameter of the front opening of the rear part of the sleeve, to allow for the rear projection to be friction-fitted into the rear part of the sleeve;

the rear part of the sleeve comprises at least two substantially spiral cam channels that are mutually symmetrical with respect to a longitudinal axis, each cam channel extending angularly between a first angular positioning element and a second angular positioning element that are diametrically opposed and formed by projections at the front of the inner guiding surface of the rear part of the sleeve, and the front part of the sleeve comprises at least two substantially spiral cam channels that are mutually symmetrical with respect to a longitudinal axis between which are arranged two diametrically opposed slots intended to receive the first and second angular positioning elements;

the eraser holder is produced in a single tubular piece with the container tube of the writing cartridge.

BRIEF DESCRIPTION OF THE DRAWINGS

Other characteristics and advantages will become apparent from the following description of non-limitative example embodiments, with reference to the figures, in which:

FIG. 1*a* diagrammatically shows a perspective view of a writing instrument according to an embodiment of the present invention, in which the protection sleeve is prevented from moving in translation and is mobile in rotation with respect to the shaft.

FIG. 1*b* diagrammatically shows an exploded perspective view of the writing instrument shown in FIG. 1*a*.

FIG. 2*a* diagrammatically shows a partial longitudinal cross-sectional view of the writing instrument shown in FIG. 1*a*, in a first position of rotation of the sleeve for which the eraser is in the retraction configuration.

FIG. 2*b* diagrammatically shows a transverse cross-sectional view of the writing instrument shown in FIG. 2*a* along the plane I-I.

FIG. 3 diagrammatically shows a partial longitudinal cross-sectional view of the writing instrument shown in FIG. 1*a*, in a second position of rotation of the sleeve for which the eraser is in maximum exit configuration.

DETAILED DESCRIPTION OF THE EMBODIMENTS OF THE PRESENT INVENTION

Figure 4:
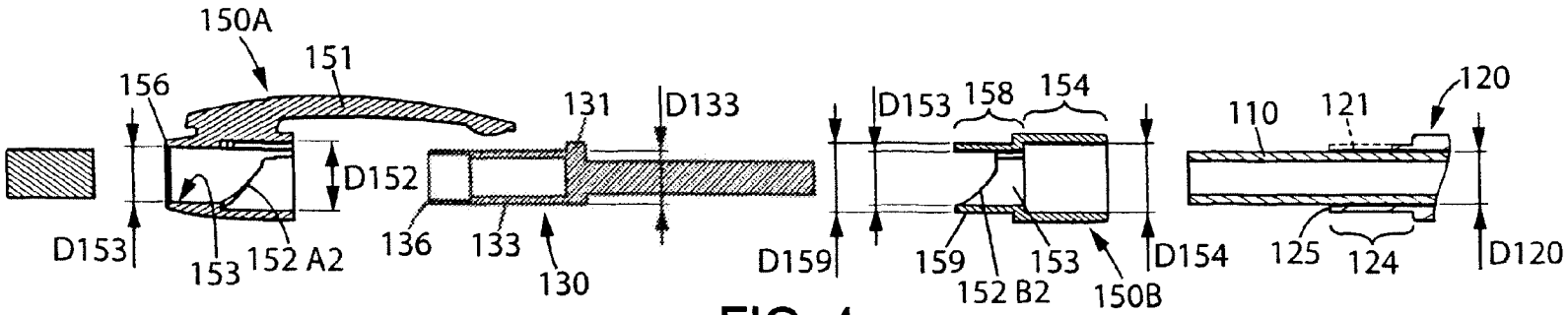
FIG. 4 diagrammatically shows a partial exploded longitudinal cross-sectional view of a writing instrument according to an embodiment of the present invention, in which the protection sleeve is mobile in translation and in rotation with respect to the shaft.

In FIGS. 1*a* and 1*b*, a writing instrument according to an embodiment of the present invention, shown in perspective, comprises a protection sleeve 50 prevented from moving in translation and mobile in rotation with respect to the shaft. In accordance with general practice in the field of writing instruments, the word "shaft" means an outer member of the instrument comprising a part for holding in the hand, it being possible for this member to be constituted by several elements securely assembled together.

The sleeve 50 preferably has a generally cylindrical inner surface, and has at its axial rear end an opening 4 for an eraser 40 fixed onto a holder 30 to pass through. In the embodiment shown, a clip 59 is formed in a single piece with the protection sleeve 50. Two opposite radially flexible arms 36 are provided on the eraser holder 30 in order to secure the front end of the eraser 40. The outer surface of these flexible arms forms part of an outer guiding surface 33 of the holder, from which project which two laterally opposite lugs 32. The eraser holder 30 preferably has a front projection 35 extending longitudinally, the outer surface of which forms approximately a cylinder, two laterally opposite flats 31 that extend longitudinally being formed along this projection 35.

The shaft comprises a first essentially tubular element 12 mounted in a front part 1 of the writing instrument that comprises a writing tip 2 and a writing cartridge (not shown) with a lead container tube 10, and further comprises a second essentially tubular element 20 firmly fitted onto the first element 12. The first element 12 of the shaft is surrounded by a grip sleeve 13, and is passed through laterally by a button 14 of a feed mechanism of the writing cartridge that is known per se. It is understood that the two elements 12 and 20 of the shaft could alternatively be produced in a single piece. For reasons of simplicity, the second element 20 is hereinafter called the shaft.

Figure 8:
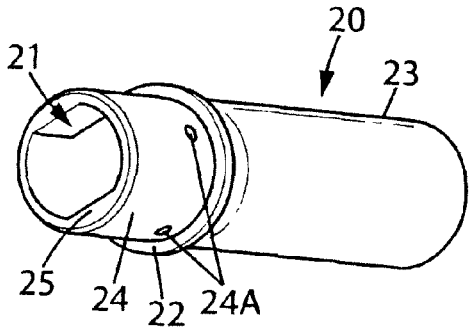
FIG. 8 diagrammatically shows a perspective view of a part of the shaft of the writing instrument shown in FIG. 1*a*.

As shown further in the perspective view shown in FIG. 8, the shaft 20 comprises a front portion 23 and a rear portion 24 both having an essentially cylindrical outer wall. Several protrusions 24A arranged around a peripheral circle project onto the outer wall of the rear portion 24. In addition, the rear portion 24 preferably has an inner wall on which two laterally opposite flats 21 are formed. At the front of the peripheral circle of the protrusions 24A, stop means 22 delimiting the rear portion 24 with respect to the front portion 23 are formed by an externally projecting annular part of the shaft 20.

In FIGS. 2*a* and 3, it appears that the sleeve 50 comprises a front portion 54 surrounding the rear portion 24 of the shaft and capable of sliding in rotation directly against the outer wall of the rear portion. This front portion 54 preferably has an inner wall comprising an annular groove 54A in which the protrusions 24A of the shaft are engaged. The front end edge 55 of the sleeve 50 is positioned substantially abutting against the annular part 22 of the shaft 20. Thus, even in the event of particularly strong pressure exerted on the eraser when the user holds the instrument by the shaft, the sleeve remains in position with respect to the shaft.

Figure 10:
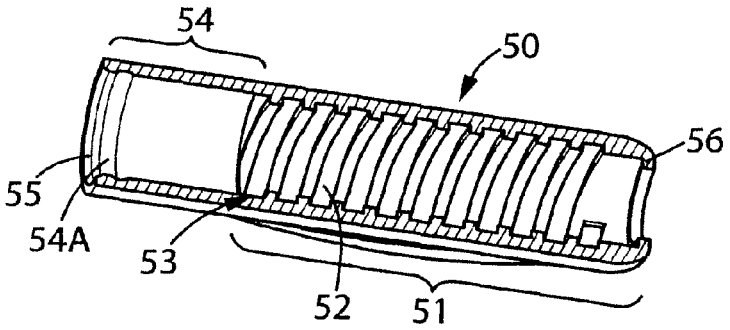
FIG. 10 diagrammatically shows a cutaway perspective view of the protection sleeve of the writing instrument shown in FIG. 1*a*.

As further shown in the perspective view shown in FIG. 10, the sleeve further comprises a rear portion 51 having an inner guiding surface 53 adjacent to the outer guiding surface 33 of the eraser holder. A generally spiral-shaped groove 52, producing a guide path for the lugs 32 of the eraser holder 30, is formed on the inner guiding surface 53. The interaction of the lugs 32 with the groove 52 makes it possible for the rotation of the sleeve 50 to drive the displacement of the eraser holder 30 relative to the sleeve.

Figure 9:
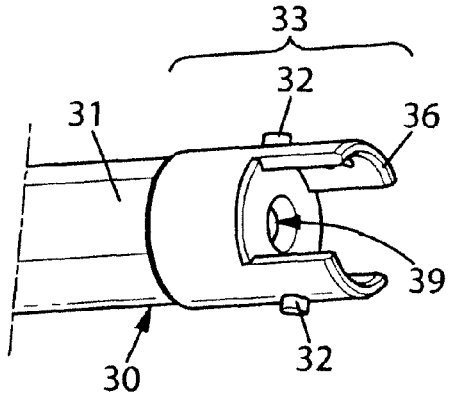
FIG. 9 diagrammatically shows a partial perspective view of the eraser holder of the writing instrument shown in FIG. 1*a*.

The front projection 35 of the eraser holder 30 preferably has a substantially cylindrical bore 37 open at its front end which comprises a bottom wall 38 at its rear end. As further shown in the perspective view shown in FIG. 9, this bottom wall 38 preferably has a central opening 39 capable of allowing the refilling of leads 3. The lead container tube 10 is arranged within the shaft 20 and the eraser holder 30, coaxially therewith, and has a rear end engaged in the bore 37 of the holder. The container tube 10 is preferably shaped in order to occupy the greater part of the depth of the bore 37 in the retraction configuration of the eraser 40 shown in FIG. 2*a*.

The sleeve 50 preferably has an annular shoulder 56 facing radially inward at the level of the opening 4 for the eraser 40 to pass through, flush with the surface of the eraser. This annular shoulder contributes to locking the eraser in the radial direction and constitutes a stop against which the flexible arms 36 of the eraser holder 30 abut in the maximum exit configuration of the eraser as shown in FIG. 3, thus preventing the exit of the holder from the sleeve. In this configuration, the end of the front projection 35 of the eraser holder is still surrounded by the rear end 25 of the shaft, so that the eraser holder is still prevented from rotating.

It will be noted that in order to pass from the first position of rotation of the sleeve (FIG. 2*a*), for which the eraser is in retraction configuration, to the second position of rotation of the sleeve (FIG. 3) for which the eraser is in maximum exit configuration, the sleeve performs several rotations.

As shown in FIGS. 1*b* and 2*b*, any rotation between the eraser holder 30 and the shaft 20 is prevented by interaction of the shape of the first longitudinal guiding members constituted by the flats 31 of the front projection 35 of the holder with the first complementary longitudinal guiding members constituted by the flats 21 of the inner wall of the rear portion 24 of the shaft. With a cutaway view which would be produced for the configuration shown in FIG. 3 along the plane I-I shown in FIG. 2*a*, the same view as FIG. 2*b* would be obtained.

It will be noted that the front projection 35 of the eraser holder slides directly against the inner wall of the shaft 20, which is advantageous in order to keep the eraser holder more firmly in axial alignment with the shaft and as a result to limit misalignments of the holder caused by the transverse forces exerted on the eraser in use.

Figure 5:
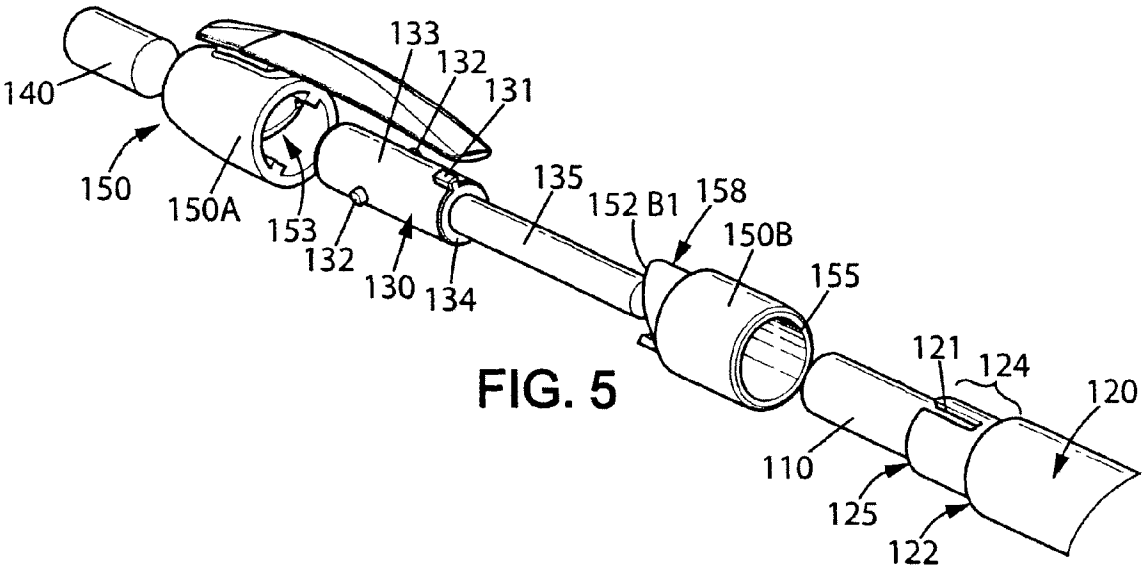
FIG. 5 diagrammatically shows a partial exploded perspective view of the writing instrument shown in FIG. 4.

In FIGS. 4 and 5, another embodiment of a writing instrument according to the invention is shown partially in exploded view, respectively in longitudinal cross-section and in perspective. A protection sleeve 150 is formed by the assembly of two parts, a front part 150B and a rear part 150A, and is mobile in translation and in rotation with respect to a shaft 120. A clip 151 is formed from a single piece with the rear part 150A of the sleeve, but it is understood that the presence of a clip is not necessary for the invention.

An eraser holder 130, prevented from rotating with respect to the shaft 120, is capable of sliding in translation in the shaft only in order to actuate a feed mechanism of a writing cartridge (not shown). It preferably has a front projection 135 extending longitudinally, the outer surface of which forms a cylinder. In addition, it has an essentially cylindrical outer guiding surface 133, the diameter D133 of which is greater than the external diameter of the front projection 135 while being substantially equal to the diameter D120 of the inner wall of the shaft 120. An annular shoulder 134 is formed at the junction between the outer guiding surface 133 and the front projection 135. At the level of a radial extension of this annular shoulder, a first longitudinal guiding member 131 is formed by an externally projecting protrusion on the outer guiding surface 133. Offset towards the rear of the holder 130 with respect to the first longitudinal guiding member 131, two laterally opposite second guiding members 132 are each formed by an externally projecting lug on the outer guiding surface 133. These two lugs 132 are arranged around a diameter of the cylinder formed by the outer guiding surface 133, but it would also be possible to provide a certain offset of the longitudinal position of the lugs.

The front projection 135 of the eraser holder 130 is fitted inside a lead container tube 110 of the writing cartridge, this tube being capable of sliding in translation inside the shaft 120 in order to actuate the feed mechanism of the writing cartridge. The fit is produced so that the lead container tube 110 is fixed in translation with the eraser holder 130. The annular shoulder 134 of the eraser holder 130 acts as a stop for the rear end of the container tube 110. A particularly tight friction-fit can be provided, so that in practice the holder and the tube cannot not be separated. It is understood that the entire eraser holder can have a bore over the whole of its length making it possible to refill the container tube with leads after having removed the eraser.

In another embodiment, the front projection of the eraser holder does not have an inner passage and a fit requiring only moderate effort can be provided so that the user can separate the eraser holder from the container tube in order to refill the tube with leads and can reassemble these two elements without any particular difficulty. Also in a further embodiment that is not shown, the eraser holder and the container tube are produced in a single tubular piece, in which case the outer guiding surface of the holder comprises a rear portion of the container tube, and the first and second longitudinal guiding members are preferably produced by moulding with this tubular piece.

The shaft 120 preferably has an essentially cylindrical outer wall and comprises a rear projection 124 the external diameter of which is smaller than the external diameter of the shaft. This rear projection 124 preferably has a longitudinal slot 121 opening onto the rear end 125 of the shaft. This slot 121 constitutes a first complementary longitudinal guiding member capable of allowing sliding in translation and without the possibility of rotation of the protrusion 131 forming the first longitudinal guiding member of the eraser holder 130. Preferably, the outer radius of the protrusion 131 does not exceed the outer radius of the rear projection 124 of the shaft.

The front part 150B and the rear part 150A of the protection sleeve 150 are designed to be force-fitted together one inside the other in order to avoid any risk of mutual separation under normal conditions of use. The front part 150B preferably has a front portion 154 surrounding the rear end 125 of the shaft.

Figure 7A:
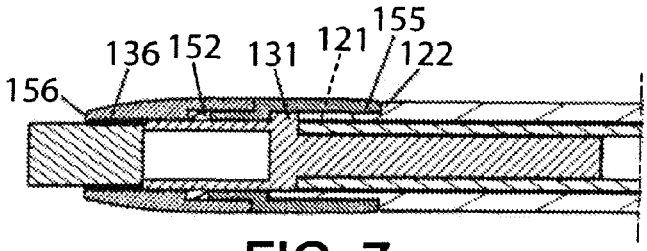
FIG. 7*a* diagrammatically shows a partial longitudinal cross-sectional view of the writing instrument shown in FIG. 4, in a second position of the sleeve for which the eraser is in maximum exit configuration.
Figure 7B:
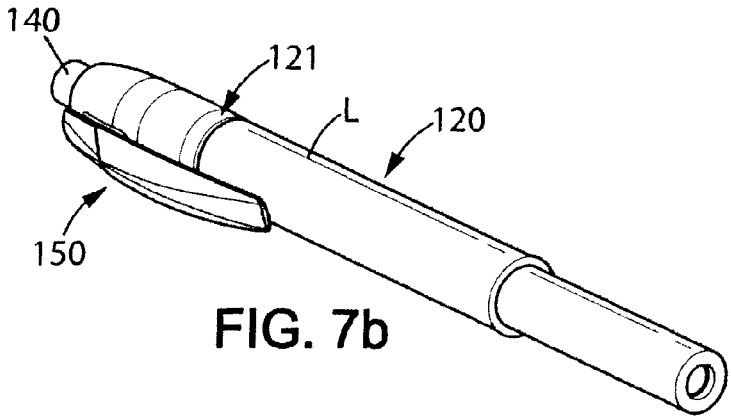
FIG. 7*b* diagrammatically shows a partial perspective view of the writing instrument shown in FIG. 7*a*.

This front portion 154 preferably has an inner diameter D154 substantially equal to the external diameter of the rear projection 124 of the shaft, so as to be able to slide in translation and in rotation directly against the outer wall of the rear projection 124. It has in addition a front end edge 155 capable of abutting against an annular shoulder 122 formed on the outer surface of the shaft by the rear projection 124. Such a stop position is produced in particular in the maximum exit configuration of the eraser, as shown in FIGS. 7*a* and 7*b*, which prevents an axial displacement of the sleeve 150 towards the shaft 120.

Figure 12:
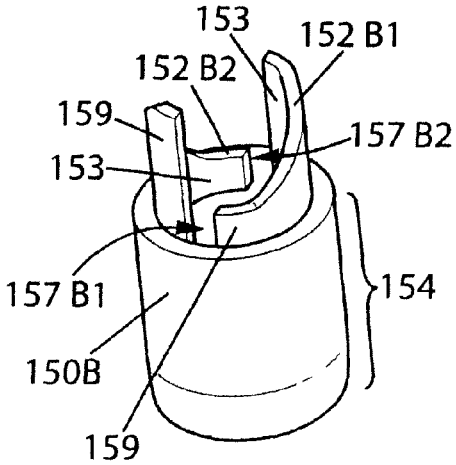
FIG. 12 diagrammatically shows a perspective view of the front part of the protection sleeve of the writing instrument shown in FIG. 4.

The front part 150B of the sleeve also preferably has a rear projection 158 that does not surround the shaft and has an outer surface 159 defining a cylinder the diameter D159 of which is substantially equal to the diameter D152 of a front opening of the rear part 150A of the sleeve. This makes it possible to forcibly friction-fit the rear projection 158 into the rear part 150A. The rear projection 158 preferably has an inner guiding surface 153 adjacent to the outer guiding surface 133 of the eraser holder 130, the diameter D153 of the inner guiding surface 153 being substantially equal to the diameter D133 of the outer guiding surface 133. This inner guiding surface 153 preferably has at least two edges constituting two substantially spiral cam channels 152B1, 152B2 mutually symmetrical with respect to a longitudinal axis, between which are arranged at least two diametrically opposed slots 157B1, 157B2 as can also be seen in the perspective view shown in FIG. 12.

The width of each slot 157B1, 157B2 is greater than or equal to the diameter of each lug 132 of the eraser holder 130, so that the front part 150B of the sleeve can be engaged around the eraser holder by the rear of the latter by passing each lug through a slot. The outer radius of the protrusion 131 of the eraser holder 130 is less than or equal to the inner diameter D154 of the front portion 154, in order to allow the front part 150B to engage around the eraser holder. This engagement is terminated when the protrusion 131 abuts against an annular inner shoulder of the front part 150B at the junction between the front portion 154 and the rear projection 158. It is understood that the width of the protrusion 131 can be greater than that of each slot 157B1, 157B2, as it is not necessary for the protrusion 131 to be able to pass through one of these slots.

Figure 11:
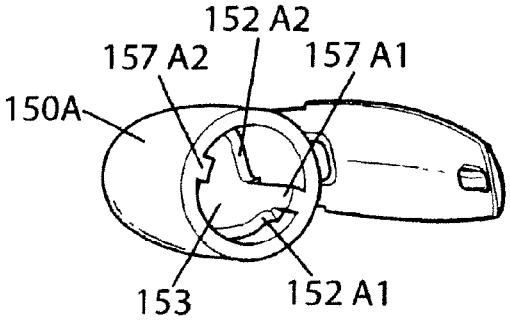
FIG. 11 diagrammatically shows a perspective view of the rear part of the protection sleeve of the writing instrument shown in FIG. 4.

The rear part 150A of the sleeve preferably has an inner guiding surface 153 with the same diameter D153 as the inner guiding surface of the rear projection 158 of the front part 150B of the sleeve. This inner guiding surface 153 is adjacent to the outer guiding surface 133 of the eraser holder 130, and in the same way as for the front part 150B, preferably has at least two edges constituting two substantially spiral cam channels 152A1 and 152A2 that are mutually symmetrical with respect to a longitudinal axis. Each cam channel 152A1, 152A2 extends angularly over at least 180° between a first angular positioning element 157A1 and a second angular positioning element 157A2, which are diametrically opposed. As can also be seen in the perspective view shown in FIG. 11, each angular positioning element 157A1, 157A2 comprises a projection formed at the front of the inner guiding surface 153 of the rear part 150A and having an extremity in the form of a rib, the width of which is substantially equal to the width of a slot 157B1, 157B2. In this way, once the front part 150B of the sleeve is engaged around the eraser holder, the rear part 150A of the sleeve is guided in translation in order to come together with the front part 150B as a result of each angular positioning element 157A1, 157A2 being capable of engaging in a corresponding slot 157B1, 157B2. Moreover, the engagement of the angular positioning elements of the rear part in the corresponding slots of the front part makes it possible to firmly prevent any relative rotation between the front part and the rear part.

The respective cam channels of the two parts of the sleeve are shaped such that at least two substantially spiral grooves 152 that are mutually symmetrical with respect to a longitudinal axis are created, each groove being delimited by at least two cam channels that are longitudinally opposite once the two parts of the sleeve are assembled. Each lug 132 constituting a second guiding member of the eraser holder 130 is engaged in a groove 152 constituting a second complementary guiding member. In this way, the rotation of the sleeve 150 drives a translational motion of the sleeve relative to the eraser holder. The sleeve is guided in translation via on the one hand the sliding of the front portion 154 of the sleeve around the rear projection 124 of the shaft and on the other hand the sliding of the inner guiding surface 153 of the sleeve around the outer guiding surface 133 of the eraser holder. It will be noted that the rear end 125 of the shaft still remains surrounded by the front portion 154 of the sleeve.

For the purposes of the invention it is not necessary for the protection sleeve to be produced in two parts. In a manner known in the art, a protection sleeve can in fact be provided in a single piece, having an inner wall that comprises at least one groove constituting the second complementary guiding member, the engagement in the groove of at least one second guiding member of the eraser holder such as a lug being achieved by plastic deformation of the inner wall and/or of the second guiding member.

Moreover, in a further embodiment (not shown) of the invention, each second guiding member can be provided as an extension of the first longitudinal guiding member of the eraser holder in the radial direction. For example, modifications that can be made to the embodiment described above (FIGS. 4 and 5) in order to arrive at this other embodiment would comprise providing for the rear projection 124 of the shaft 120 to be radially intercalated between the outer guiding surface 133 of the eraser holder and the inner guiding surface 153 of the sleeve, lengthening the rear projection 124 and increasing the diameter D153 of the inner guiding surface. It is also possible to provide at least two diametrically opposed longitudinal guiding slots 121, remove the protrusion 131 and extend each lug 132 radially outwards so that it passes through a slot 121 with the possibility of sliding in translation in the slot and is engaged in a groove 152 of the sleeve. The part of a lug 132 arranged in a slot 121 could take a form similar to that of the removed protrusion 131, and would constitute a first longitudinal guiding member, while the cylindrical part of the lug 132 projecting through the slot 121 in order interact with a groove 152 would constitute a second guiding member. It is understood that this embodiment can be combined with the one previously mentioned, comprising producing the eraser holder in a single tubular piece with the container tube.

Figure 6A:
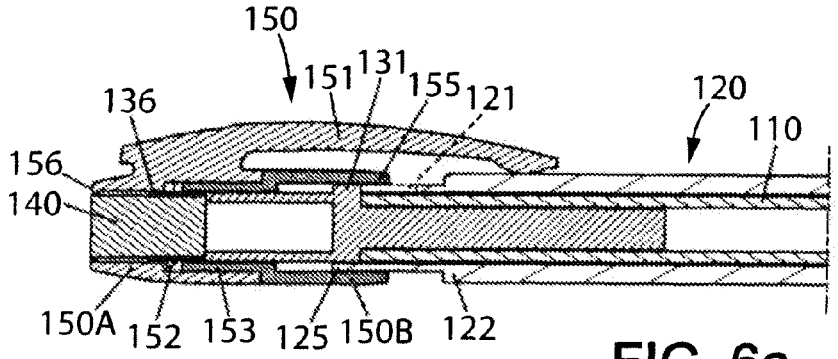
FIG. 6*a* diagrammatically shows a partial longitudinal cross-sectional view of the writing instrument shown in FIG. 4, in a first position of the sleeve for which the eraser is in the retraction configuration.
Figure 6B:
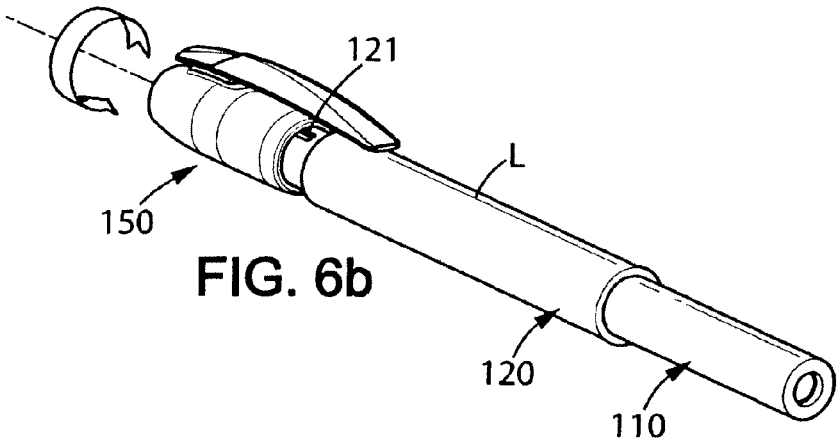
FIG. 6*b* diagrammatically shows a partial perspective view of the writing instrument shown in FIG. 6*a*.

In the embodiment described with respect to FIGS. 4 and 5, and as shown in FIGS. 6*a* and 6*b*, the sleeve 150 can be moved into a first position for which the eraser 140 is in the retraction configuration. A first longitudinal space is provided between the front end edge 155 of the sleeve and the annular shoulder 122 of the shaft, and a second longitudinal space is provided between the protrusion 131 of the eraser holder 130 and the front end of the longitudinal slot 121 of the shaft in which the protrusion 131 can slide in order to actuate the feed mechanism of the writing cartridge.

The rear part 150A of the sleeve preferably has an annular shoulder 156 having a relatively small radial thickness, inwardly directed at the level of the opening for the eraser 140 to pass through and flush with the surface of the eraser. The eraser holder 130 preferably has at the rear a tubular projection 136 having a radial thickness substantially equal to that of the annular shoulder 156 and capable of keeping a grip on a portion of the eraser 140. A third longitudinal space is provided between the tubular projection 136 and the annular shoulder 156, larger than or equal to the first longitudinal spacer in order not to prevent the front end edge 155 of the sleeve from abutting against the annular shoulder 122 of the shaft in the maximum exit configuration of the eraser as shown in FIG. 7*a*.

Starting from the first position of the sleeve 150, as shown in FIGS. 6*a* and 6*b*, pressure exerted on the eraser 140 or on the sleeve 150 in the direction of the shaft 120 causes the sliding in translation of the eraser holder 130 and as a result, actuation of the feed mechanism of the writing cartridge. The stroke of this translation is limited by the abutment of the front end edge 155 of the sleeve against the annular shoulder 122 of the shaft or by the abutment of the protrusion 131 against the front end of the slot 121 of the shaft.

It will be noted that the eraser holder 130 slides directly against the inner wall of the rear projection 124 of the shaft, which is advantageous in order to keep the eraser holder more firmly in axial alignment with the shaft and as a result to limit misalignments of the holder caused by the transverse forces exerted on the eraser in use.

As shown in FIGS. 7*a* and 7*b*, the sleeve 150 can be moved into a second position for which the eraser 140 is in the maximum exit configuration. This second position is obtained starting from the first position by means of a rotation of the sleeve 150 about its longitudinal axis in the direction of the arrow shown in FIG. 6*b*. As shown in FIG. 7*b*, the sleeve 150 and the clip have been rotated by more than 90° with respect to the shaft 120, the position of the shaft denoted by the imaginary line L in the alignment of the slot 121 remaining unchanged. In this second position of the sleeve 150, the front end edge 155 of the sleeve abuts against the annular shoulder 122 of the shaft, which prevents any additional axial displacement of the sleeve towards the shaft and as a result prevents the eraser holder 130 from sliding in translation.

The maximum exit configuration of the eraser 140 therefore corresponds to a position of the sleeve achieving a locking of the feed of the writing cartridge, which has the advantage in particular of allowing the user to use the eraser while holding the writing instrument entirely or at least partially by the shaft 120 without risking causing an undesired feed of the cartridge. It will be noted that in this embodiment the protection sleeve can be proportionally shorter with respect to the shaft in comparison with the embodiment relating to FIGS. 1*a* and 1*b*. Such locking makes it possible for a return spring having a relatively low stiffness to be provided for the writing cartridge so that the actuation of the feed mechanism of the cartridge requires less effort from the user, which also makes it possible to reduce the weight and cost of the return spring.

The writing instrument according to the invention described in the above-mentioned embodiments is of the propelling pencil type, but it is understood that the invention is not limited to the use of a writing cartridge provided with leads. The invention can in fact be applied to a writing instrument comprising a cartridge of erasable ink. Moreover, it is not indispensable for the writing cartridge to comprise a container tube capable of actuation in order to slide in a shaft. In particular, in the case of an ink cartridge, the latter can be provided connected to a fixed writing tip.

The invention claimed is:

1. A writing instrument comprising:

a shaft having an inner wall and extending longitudinally between a front end with a writing tip and a rear end that includes an eraser exit device that further comprises: an eraser capable of adopting a maximum exit configuration and a retraction configuration in which it is at least partially protected;

an eraser protection sleeve, mobile at least in rotation with respect to the shaft between a first position for which the eraser is in the retraction configuration and a second position for which the eraser is in the maximum exit configuration; and an eraser holder to which the eraser is fixed, with at least one first longitudinal guiding member interacting directly with a first complementary longitudinal guiding member integral with the shaft in order to prevent any rotational motion between the holder and the shaft, the holder having a securing portion capable of keeping a grip on a portion of the eraser and further having a front projection extending longitudinally which is at least partly surrounded by the shaft, the front projection being substantially unmovable relative to the securing portion, wherein the eraser holder further comprises at least one second guiding member interacting with a second complementary guiding member integral with the sleeve so that the rotation of the sleeve drives a relative translational motion between the holder and the sleeve, wherein the sleeve has a front portion surrounding the rear end of the shaft and a rear portion not surrounding the shaft that has an inner guiding surface comprising the second complementary guiding member, the eraser holder being capable of sliding directly against the inner wall of the shaft and having an outer guiding surface comprising the second guiding member.

2. The writing instrument according to claim 1, wherein the shaft further comprises stop means capable of interacting with a front end edge of the sleeve in order to prevent an axial displacement of the sleeve towards the shaft at least in the maximum exit configuration of the eraser.

3. The writing instrument according to claim 1, wherein the outer guiding surface of the eraser holder is adjacent to the inner guiding surface of the sleeve, and the at least one second guiding member projects radially outwards and is axially offset towards the rear of the eraser holder in relation to the at least one first longitudinal guiding member.

4. The writing instrument according to claim 1, wherein the second complementary guiding member is a groove formed in the inner guiding surface of the sleeve.

5. The writing instrument according to claim 1, the outer surface of the front projection of the eraser holder at least approximately forms a cylinder.

6. The writing instrument according to claim 4, wherein the groove constituting the second complementary guiding member forms a spiral path, and the eraser holder has two laterally opposed second guiding elements engaged in the groove.

7. The writing instrument according to claim 1, wherein the sleeve is linked to the shaft so as to be able to rotate with respect to the shaft without the possibility of translational motion.

8. The writing instrument according to claim 7, wherein the shaft comprises a rear portion having an essentially cylindrical outer wall surrounded by the front portion of the sleeve and which comprises at least two protrusions arranged around a peripheral circle, the front portion having an inner wall comprising an annular groove in which the protrusions are engaged.

9. The writing instrument according to claim 8, wherein the at least one first longitudinal guiding member is formed by a flat extending longitudinally on the outer surface of the front projection of the holder, and the rear portion of the shaft has an inner wall on which is formed at least one flat constituting the first complementary longitudinal guiding member.

10. The writing instrument according to claim 2, wherein the shaft comprises a rear portion having an essentially cylindrical outer wall surrounded by the front portion of the sleeve and which comprises at least two protrusions arranged around a peripheral circle, and wherein the stop means are formed at the front of the protrusions by an externally projecting annular part of the shaft, the front end edge of the sleeve being capable of abutting against the annular part.

11. The writing instrument according to claim 1, further comprising a feed mechanism of a writing cartridge, wherein the shaft comprises a first essentially tubular part through which an actuation button of the feed mechanism passes, and includes a second essentially tubular part comprising the first complementary longitudinal guiding member and linked in a fixed manner to the first part.

12. The writing instrument according to claim 1, further comprising a feed mechanism of a writing cartridge, wherein the eraser holder is firmly connected to a container tube of the cartridge arranged within the shaft coaxially with the holder and capable of sliding in translation with the holder in order to actuate the feed mechanism.

* * * * *

UNITED STATES PATENT AND TRADEMARK OFFICE

CERTIFICATE OF CORRECTION

PATENT NO. : 8,915,663 B2
APPLICATION NO. : 12/863273
DATED : December 23, 2014
INVENTOR(S) : Franck Rolion et al.

It is certified that error appears in the above-identified patent and that said Letters Patent is hereby corrected as shown below:

On the title page, under abstract "12 Claims, 4 Drawing Sheets" should read -- 19 Claims, 4 Drawing Sheets --.

In the Claims

Please Insert Claims 13-19 After Claim 12 In Column 13, Row 28:

-- 13. The writing instrument according to claim 12, wherein the front projection as well as the outer guiding surface of the holder are essentially cylindrical, the diameter of the outer guiding surface being greater than the external diameter of the front projection, while being substantially equal to the diameter of the inner wall of the shaft.

14. The writing instrument according to claim 13, wherein the at least one first longitudinal guiding member comprises an externally projecting protrusion on the outer guiding surface of the holder, and the first complementary longitudinal guiding member comprises a longitudinal slot formed in the shaft, the slot opening onto the rear end of the shaft and being capable of allowing the protrusion to slide in translation without rotating.

15. The writing instrument according to claim 12, wherein the shaft has a cylindrical outer wall and includes a rear projection, the external diameter of which is smaller than the external diameter of the shaft, so that the outer surface of the shaft forms an annular shoulder constituting the stop means capable of interacting with a front end edge of the sleeve, the front portion of the sleeve having an inner diameter substantially equal to the external diameter of the rear projection.

16. The writing instrument according to claim 12, wherein the sleeve comprises at least a front part and a rear part assembled to each other and having inner guiding surfaces of the same diameter, each inner guiding surface being adjacent to the outer guiding surface of the eraser holder and having at least one edge constituting a cam channel, the cam channels of the front and rear parts of the sleeve being shaped such that a groove is created delimited by two cam channels that are longitudinally opposite once the two parts are assembled, each groove constituting the second complementary guiding member.

Signed and Sealed this
Nineteenth Day of May, 2015

Michelle K. Lee

Michelle K. Lee
*Director of the United States Patent and Trademark Office*

17. The writing instrument according to claim 16, wherein the rear portion of the sleeve has a circular front opening of a certain diameter and the front part of the sleeve has a rear projection comprising at least one cam channel, the rear projection having an external surface defining a cylinder, the diameter of which is substantially equal to the diameter of the front opening of the rear portion of the sleeve, in order to allow the rear projection to be friction-fit into the rear part of the sleeve.

18. The writing instrument according to claim 16, wherein the rear part of the sleeve comprises two substantially spiral cam channels that are mutually symmetrical with respect to a longitudinal axis, each cam channel extending angularly between a first angular positioning element and a second angular positioning element which are diametrically opposed and formed by projections at the front of the inner guiding surface of the rear part, and in which the front part of the sleeve comprises two substantially spiral cam channels that are mutually symmetrical with respect to a longitudinal axis between which are arranged two diametrically opposed slots intended to receive the first and second angular positioning elements.

19. The writing instrument according to claim 12, wherein the eraser holder forms a single tubular piece with the container tube of the writing cartridge, the container tube forming the front projection of the holder. --.